US006098846A

United States Patent [19]

Yazawa et al.

[11] Patent Number: 6,098,846

[45] Date of Patent: Aug. 8, 2000

[54] DOUBLE CHAMBER AEROSOL CONTAINER

[75] Inventors: Iwao Yazawa, Higashimurayama; Toshiyuki Mitsui, Saitama-ken; Kazunori Hoshino, Zushi, all of Japan

[73] Assignee: Toyo Aerosol Industry Co., Ltd., Tokyo, Japan

[21] Appl. No.: 09/216,729

[22] Filed: Dec. 21, 1998

[30] Foreign Application Priority Data

Aug. 19, 1998 [JP] Japan ..... 10-233307

[51] Int. Cl.[7] ..... B65D 35/28

[52] U.S. Cl. ..... 222/95; 222/402.24

[58] Field of Search ..... 222/95, 105, 402.1, 222/402.24

[56] References Cited

U.S. PATENT DOCUMENTS

| | | | |
|---|---|---|---|
| 4,457,454 | 7/1984 | Meshberg | 222/95 |
| 5,083,681 | 1/1992 | Nye | 222/402.24 |
| 5,622,282 | 4/1997 | Yazawa et al. | 222/95 |
| 5,630,530 | 5/1997 | Geier et al. | 222/95 |
| 5,938,085 | 8/1999 | Conroy et al. | 222/402.24 |

FOREIGN PATENT DOCUMENTS

| | | | |
|---|---|---|---|
| 2685285 | 6/1993 | France | 222/105 |

*Primary Examiner*—Joseph A. Kaufman
*Attorney, Agent, or Firm*—Kanesaka & Takeuchi

[57] ABSTRACT

A double chamber aerosol container has a soft elastic inner sack, mounted within a metal container body, and a housing mounted to a top end of an inner periphery of the inner sack. The inner sack is in contact with special sized temporarily fitting portion as well as insertion contact portion of the housing to prevent the propellant from leaking out. Where an inner diameter of the top end of the inner periphery of the inner sack is 1, the outer diameter of an insertion contact portion of the housing is set to 1.02 to 0.98, the maximum outer diameter of the temporarily fitting portion is set to 0.97 to 0.95, the minimum outer diameter of the temporarily fitting portion is set to 0.94 to 0.88, and the minimum portion is formed below the maximum portion as well as the width in the up and down directions of the temporarily fitting portion is set to 0.19 to 0.10.

5 Claims, 2 Drawing Sheets

DOUBLE CHAMBER AEROSOL CONTAINER

BACKGROUND OF THE INVENTION

1. Field of the Invention

This invention relates to an aerosol container for filling and spraying aerosol contents such as human body treatment products such as hair care products, cosmetics, antiperspirants, deodorants, and others, goods for household such as insecticides, coating materials, cleaners, and others, industrial materials, automobile goods, and so on. Particularly, this invention relates to a double chamber aerosol container in which an inner sack made of a soft, elastic material is mounted within the aerosol container body.

2. Description of Related Art

An aerosol container has been known in which an inner sack is attached inside an aerosol container body made of, e.g., metal to prevent the metal container body from corroding caused by aerosol contents. In a case that such an aerosol container is used where such an inner sack is contained in the container body, a propellant is permeable through the inner sack because the inner sack is formed of a thin sack made of a soft elastic, readily transformed material. Permeated propellant may therefore leak outside via a gap between the inner surface of the container body and the outer surface of the inner sack, and the aerosol container frequently has a trouble with spraying of the aerosol contents where it is kept for a long term.

Another aerosol container has been known to have, at the top of the inner sack, a flange portion placed between the housing and the inner surface of the aerosol container in utilizing the soft and elastic property of the inner sack to keep air-tightness by the elasticity of the flange portion.

However, in this case, since the material of the inner sack itself can generally allow the propellant to permeate the vaporized propellant may permeate this flange portion and leak little by little outside, thereby frequently rendering the aerosol container incapable of spraying after it is kept for a long term.

To mount a housing on a top of an inner periphery of the inner sack, it is favorable for the purpose of leakage prevention that the housing is inserted and fitted tightly in the inner periphery of the top end of the inner sack. From a viewpoint to this demand on sealing tightly, it is desirable to design that the outer diameter of the insertion portion of the housing is larger than the diameter of the inner periphery of the top end of the inner sack.

However, if the outer diameter of the housing is merely larger than the diameter of the inner periphery of the top end of the inner sack, the inner sack may be broken, and when the housing is mounted to the inner sack attached to the container body, the inner sack may be hit to incline or move, thereby preventing the inner sack and the housing from fitting property to each other and resulting in a major cause of leakage.

SUMMARY OF THE INVENTION

It is an object of the invention to provide a double chamber aerosol container in which a propellant is prevented from leaking caused by permeation by using, for the aerosol container, an inner sack made of a sheet or film of a single layer, which is formed of a material selected from a soft, elastic ethylenevinylalcohol, polypropylene, polyacrylonitrile, polyethyleneterephthalate, high density polyethylene, low density polyethylene, straight-chain type low density polyethylene, polyamide, etc., and in which the spraying pressure is not weakened by leakage of the propellant to the outside even where it is kept for a long term, thereby being capable of spraying the aerosol contents after kept for the long term.

It is another object of the invention to provide an aerosol container in which breakdown of an inner sack is avoided where an inserted portion of a housing is made larger than a diameter of an inner periphery of a top end of the inner sack to make the inserted portion fit well to the inner periphery of the top end, in which the inner sack is prevented from hitting to be inclined or moved when the housing is mounted on the inner sack to make the inner sack and the housing fit accurately to each other, and in which breaking of air-tightness is prevented during assembling of the aerosol container.

The foregoing objects are accomplished with a double chamber aerosol container having a housing having a valve assembly, a ring-shaped brim extended from a top end of an outer periphery of the housing, an insertion contact portion, and a temporarily fitting portion formed at a lower end of the insertion contact portion; an inner sack made of a soft, elastic material, closely contacting with the insertion contact portion of the housing at a top end of an inner periphery of the inner sack and having a flange projecting from a top end of an outer periphery of the inner sack; a container body made of a metal, placed inside the inner sack and having a ring-shaped projection extending inward; a ring-shaped gasket placed between an upper surface of the ring-shaped projection extending inward in the container body and a lower surface of the flange of the inner sack; and a ring-shaped top gasket disposed between a top end surface of the inner sack and the ring-shaped brim extended from the top end of an outer periphery of the housing, wherein, where an inner diameter of the top end of the inner periphery of the inner sack is 1, an outer diameter of the insertion contact portion of the housing in contacting with the inner sack is set to 1.02 to 0.98; a maximum outer diameter portion of the temporarily fitting portion is set to 0.97 to 0.95; a minimum outer diameter portion of the temporarily fitting portion is set to 0.94 to 0.88; a width in up and down directions of the temporarily fitting portion is 0.10 to 0.19; and the minimum outer diameter portion is formed lower than a position of the maximum outer diameter portion.

According to a preferred embodiment of the invention, a lid having an orifice for a stem formed at a center of the lid may be disposed on a top end surface of the housing, and wherein the container body is secured to the housing upon folding a top edge of the container body toward a top surface of the lid.

The inner sack can be formed of a sheet or film of a single layer using a material which is selected from ethylenevinylalcohol, polypropylene, polyacrylonitrile, polyethyleneterephthalate, high density polyethylene, low density polyethylene, straight-chain type low density polyethylene, and polyamide. The inner sack can be formed of a sheet or film of multiple layers stacked of multiple materials selected from ethylenevinylalcohol, polypropylene, polyacrylonitrile, polyethyleneterephthalate, high density polyethylene, low density polyethylene, straight-chain type low density polyethylene, and polyamide. The inner sack can also be formed of a multilayer sheet or film in which polyethylene or polypropylene is disposed on opposite surfaces of an ethylenevinylalcohol film.

Since this invention is thus constituted, the propellant of the aerosol contents may be permeated little by little through the inner sack and may leak into a space between the container body and the inner sack, where the aerosol contents made of proper contents and a propellant are filled in the inner sack.

The propellant thus leaked, after staying in a space between the outer periphery of the inner sack and the inner periphery of the container body, may spill over the top end of the container body little by little through this space. However, because the ring gasket is disposed between the top surface of the ring-shaped projection extending inward in the container body and the lower surface of the flange of the top end of the inner sack, the propellant permeated through the inner sack may be prevented from leaking outside by means of the ring-shaped gasket.

The propellant that may spill over through a tiny gap created at the space located between the housing disposed on the top end of the inner periphery of the inner sack and the inner sack, is prevented from leaking by means of the top gasket disposed between the top surface of the inner sack and the lower surface of the ring-shaped brim of the housing, and therefore, no leak is made outside. Accordingly, even if the inner sack is made of a material having a gas permeable property, the propellant is prevented from leaking outside, and the aerosol container can offer stable spraying even if it is kept for a long term.

With this invention, the insertion contact portion of the housing is made larger than the diameter of the top end of the inner periphery of the inner sack to prevent the inner sack from subjecting to breaking while the close contact between the insertion contact portion and the top end of the inner periphery is made sufficient, thereby allowing the housing to be fitted accurately to the inner sack without inclining or moving the inner sack when the housing is mounted on the inner sack, and thereby preventing air from leaking during the assembling process.

To obtain this technical effect, the following numeral limitations are required. That is, where an inner diameter (a) of the top end of the inner periphery of the inner sack is 1, an outer diameter (b) of the insertion contact portion of the housing in contacting with the inner sack is required to be 1.02 to 0.98. If the outer diameter (b) of the insertion contact portion of the housing is larger than 1.02, the insertion contact portion of the housing is inserted uneasily to the top end of the inner periphery of the inner sack, thereby possibly hitting the inner sack in the container body to move the inner sack or breaking the inner sack. If the outer diameter (b) of the insertion contact portion of the housing in contacting with the inner sack is set smaller than 0.98, the insertion contact portion of the housing is inserted loosely to the top end of the inner periphery of the inner sack, so that the inner sack is axially shifted from the insertion contact portion of the housing, and so that the inner sack is contracted unevenly by means of the insertion contact portion when the housing is mounted in the container body, thereby causing leakage. In addition, when the container body is wrapped from its outer peripheral surface, intensity of such wrapping may become uneven, so that the spraying gas may be leaked.

Where the inner diameter (a) of the top end of the inner periphery of the inner sack is 1, the maximum outer diameter portion (c) of the temporarily fitting portion is required to be 0.97 to 0.95. This temporarily fitting portion has a small diameter (a) than an inner diameter of the top end of the inner periphery of the inner sack, thereby allowing the housing to be inserted easily to the top end of the inner periphery of the inner sack. If the maximum outer diameter portion (c) of the temporarily fitting portion is set larger than 0.97, the temporarily fitting portion cannot be inserted smoothly in a top end of the inner periphery of the inner sack. Therefore, when the temporarily fitting portion is inserted in the top end in the inner sack, the maximum outer diameter portion (c) of the temporally fitting portion may be caught to scratch the inner periphery of the top end of the inner sack, thereby creating causation for leakage.

Where the inner diameter (a) of the top end of the inner periphery of the inner sack is 1, if the maximum outer diameter portion (c) of the temporarily fitting portion is set smaller than 0.95, a gap unnecessary for insertion work is created between the top end of the inner periphery of the inner sack and the portion. The temporarily fitting portion is inserted too loosely to the top end of the inner periphery of the inner sack, so that the inner sack is axially shifted from the insertion contact portion of the housing, so that wrinkles may be generated at the temporarily fitting portion where the housing is mounted on the container body, and so that such wrinkles make uneven a contraction degree of the inner sack by the insertion contact portion.

Where the inner diameter (a) of the top end of the inner periphery of the inner sack is 1, it is required that a minimum outer diameter portion (d) of the temporarily fitting portion is set to 0.94 to 0.88 and that the minimum outer diameter portion is formed lower than a position of the maximum outer diameter portion. If the minimum outer diameter portion (d) of the temporarily fitting portion is set larger than 0.94, the lower end of the temporally fitting portion may be caught when the fitting portion is inserted in the top end of the inner sack, thereby possibly scratching the inner periphery of the top end of the inner sack, and creating causation for leakage.

Where the inner diameter (a) of the top end of the inner periphery of the inner sack is 1, if the minimum outer diameter portion (d) of the temporarily fitting portion is set smaller than 0.87, an unnecessary gap is created during the insertion work between the top end of the inner periphery of the inner sack and the temporarily fitting portion in the same manner as in the case that the maximum outer diameter is made unnecessarily small, thereby rendering too loose for the insertion of the temporarily fitting portion into the top end of the inner periphery of the inner sack. Therefore, the inner sack is axially shifted from the insertion contact portion of the housing, so that wrinkles may be generated at the temporarily fitting portion where the housing is mounted on the container body, and so that such wrinkles make uneven a contraction degree of the inner sack by the insertion contact portion.

Where tile inner diameter (a) of tile top end of the inner periphery of tile inner sack is 1, a width in up and down directions of the temporarily fitting portion is required to be 0.10 to 0.19. If the width of the temporarily fitting portion in the up and down directions is set larger than 0.19, a formed length of the insertion contact portion of the housing becomes shorter, so that the container cannot ensure adequate sealing between the insertion contact portion and the top end of tile inner periphery of tile inner sack. If the width of tile temporarily fitting portion in the up and down directions is set smaller than 0.10, the insertion contact portion may not be properly introduced to the top end of the inner periphery of the inner sack.

Where the planer lid is disposed on tile top of the housing, and where a top edge of the container body is folded toward a top surface of tile lid, the housing is readily secured to tile container body.

The above double chamber aerosol container can be used for, as contents, hair care products, cosmetics, antiperspirants, deodorants, other human body products, insecticides, coating materials, cleaners, other goods for household, industrial materials, automobile goods, and so on. As hair care products, the aerosol container can be used for hair set sprays, hair dresser conditioners, hair shampoos, hair conditioners, acidic hair dyes, oxidizing two-agent type permanent hair dyes, color sprays, decolorant, agents for permanently waving treatment, hair restorers, and so on. As cosmetics, the aerosol container can be used for shaving creams, after-shave lotions, perfumes, Eau de Colognes, facial cleansing agents, sunscreens, foundation creams, depilatories, decolorants, bath gels, toothpastes, and so on. Antiperspirants, deodorants, body shampoos, etc. As other human body treatment products, the aerosol container can be used for muscular antiphlogistics, skin disease treatments, dermatophytosis medicines, other medicines, insect repellents, coolants, cleaners, oral agents, etc.

As for insecticides, the aerosol container can be used for e.g., air-spray insecticides, insecticides for cockroach, insecticides for gardening, insecticides for ticks, pesticides for noxious insects, etc. As coating agents, the aerosol container can be used for e.g., paints for house, paints for automobile, undercoating agents, etc. As cleaners, the aerosol container can be used for glass cleaners for house, carpet cleaners, bath cleaners, floor and furniture cleaners, shoe and skin cleaners, wax cleaners, etc. As other goods for household, the aerosol container can be used for e.g., room deodorants, deodorants for toilet, waterproofing agents, starches for washing, herbicides, insecticides for clothes, flame proofing agents, fire extinguishers, antifungals, deodorants for garbage, etc.

As industrial use, the aerosol container can be used for e.g., lubricants, anticorrosives, adhesives, metal flaw detecting agents, mold-releasing agents, caulking agents, etc. As automobile use, the aerosol container can be used for, e.g., defrosting agents, antifreezing or thawing agents, puncture repairers, engine cleaners, etc. As other uses, the aerosol container can be used for, e.g., animal care goods, hobby goods, amusement goods, etc.

DESCRIPTION OF PREFERRED EMBODIMENTS

Figure 1:
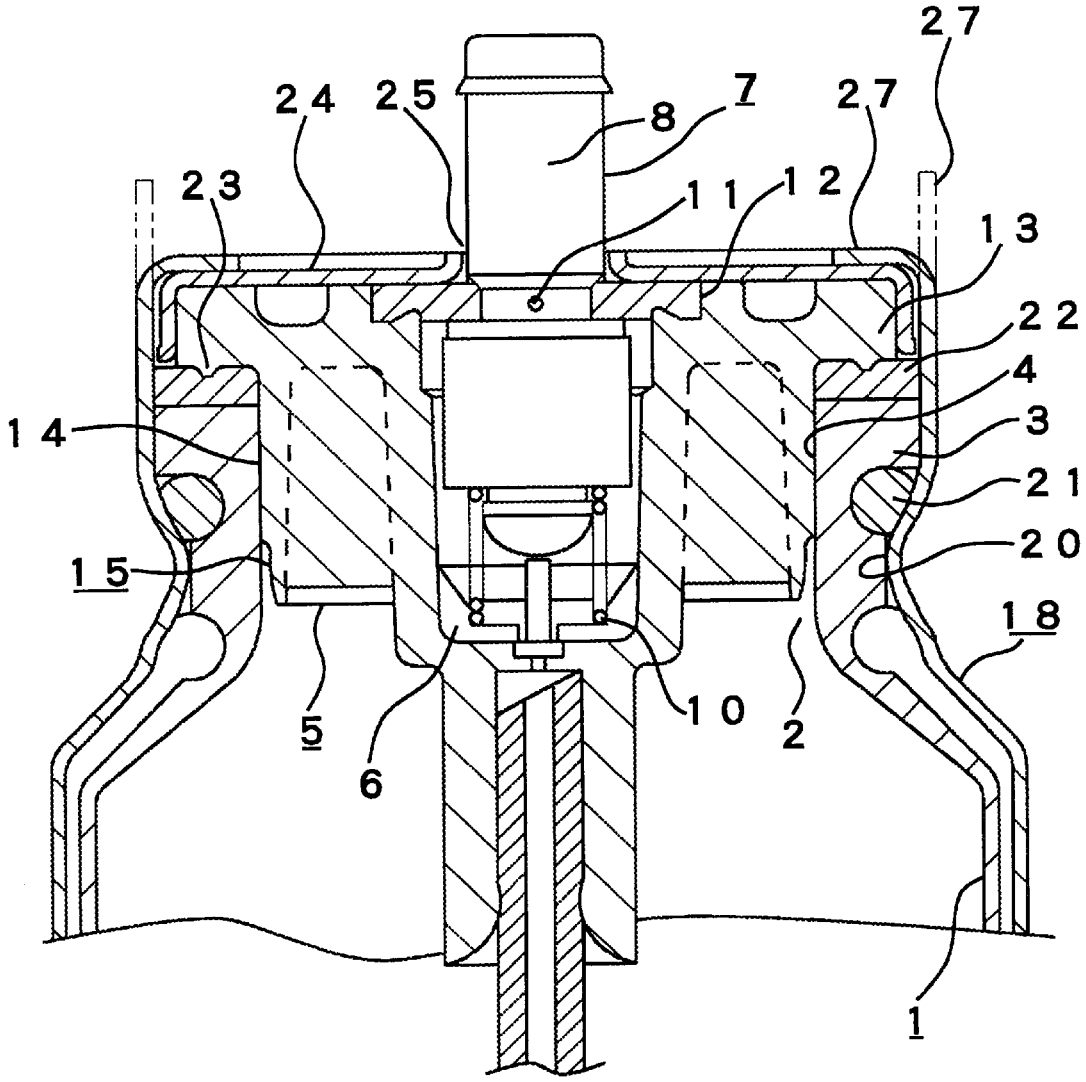
FIG. 1 is a cross section showing an aerosol container according to an embodiment of the invention.
Figure 2:
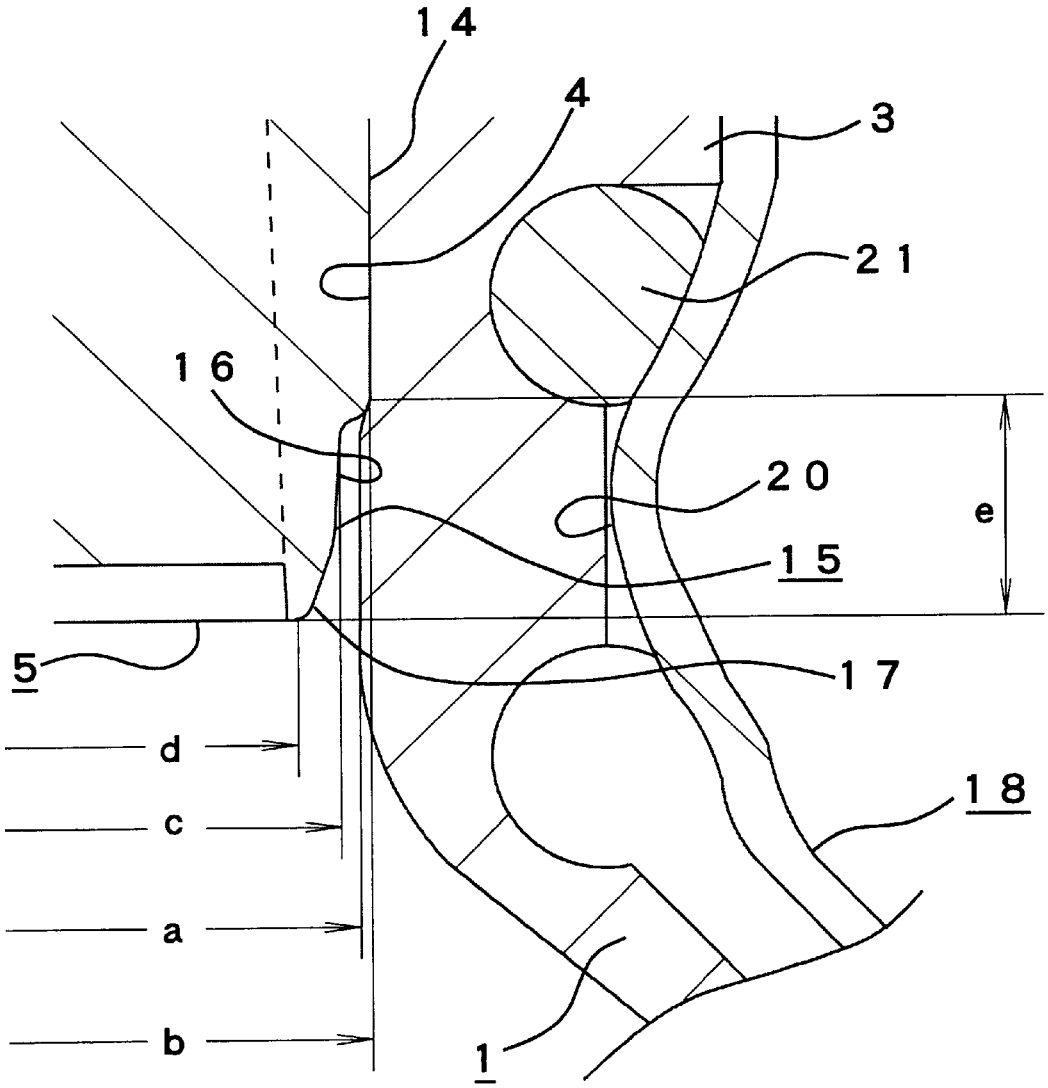
FIG. 2 is an enlarged cross section showing a portion of a temporarily fitting portion of the aerosol container in FIG. 1.

Referring to the drawings, a double chamber aerosol container according to a preferred embodiment of the invention is described. Numeral 1 represents an inner sack, in which an opening 2 is formed at a top end of the inner sack and a flange 3 is extended from an outer periphery of the top end of the opening 2. The inner sack 2 is formed in a way capable of readily transforming in use and is made of a sheet or film of a singe layer of a material selected from ethylenevinylalcohol, polypropylene, polyacrylonitrile, polyethyleneterephthalate, high density polyethylene, low density polyethylene, straight-chain type low density polyethylene, and polyamide, which are soft and elastic.

In another embodiment, the inner sack 1 is formed of a sheet or film of multiple layers in which an ethylenevinylalcohol film is formed with polyethylene films provided on opposite sides of the ethylenevinylalcohol film. The sheet or film of multiple layers also be formed of an ethylenevinylalcohol film with polypropylene films provided on opposite sides of the ethylenevinylalcohol film.

In yet another embodiment, the sheet or film of multiple layers also be formed of multiple materials selected from ethylenevinylalcohol, polypropylene, polyacrylonitrile, polyethyleneterephthalate, high density polyethylene, low density polyethylene, straight-chain type low density polyethylene, polyamide, and so on. A housing 5 is disposed on the top end of the inner periphery 4 of the opening 2 of the inner sack 1.

The housing 5 is made of a rigid resin material and is formed with a valve assembly 7 controlling spraying of aerosol contents at a mounting recess 6 provided at a center of the housing. In the valve assembly a stem 8 whose lower end is inserted in the mounting recess 6 is urged outwardly by means of a coil spring 10 wound between a bottom of the mounting recess 6 and a lower end of the stem 8.

This stem 8 is formed with a spraying route, not shown, with a bottom for guiding the aerosol contents in the vertical direction at the center of the stem 8, and an orifice 11 in communication with the spraying route is opened at a side of the stem 8. The orifice 11 is normally sealed by a stem gasket 12, and when the stem 8 is pressed in an inside direction of the mounting recess 6, the orifice 11 can be made open upon transforming the stem gasket 12.

The housing 5 has a ring-shaped brim 13 on a top end of an outer periphery of the housing 5, and an insertion contact portion 14 is arranged to closely contact with the top end 4 of the inner periphery of the opening 2 of the inner sack 1. A temporarily fitting portion 15 is formed in continuation of the lower end of the insertion contact portion 14. The insertion contact portion 14 of the housing 5 is mounted on the top end 4 of the inner periphery of the inner sack 1.

Where an inner diameter (a) of the top end 4 of the inner periphery of the inner sack 1 is set to be 1, an outer diameter (b) of the insertion contact portion 14 of the housing 5 in contacting with the inner sack 1 is set to be 1.02 to 0.98. Also, where the inner diameter (a) of the top end 4 of the inner periphery of the inner sack 1 is set to be 1, the outer diameter of the maximum portion (c) of the temporarily fitting portion 15 is set to be 0.97 to 0.95. The temporarily fitting portion 15 has a diameter smaller than the inner diameter (a) of the top end 4 of the inner periphery of the inner sack 1 and allows the housing 5 to be inserted in the top end 4 of the inner periphery of the inner sack 1 easily.

Where the inner diameter (a) of the top end 4 of the inner periphery of the inner sack 1 is set to be 1, the outer diameter (d) of the minimum portion 17 of the temporarily fitting portion 15 is set to 0.94 to 0.88, and the minimum portion 17 is formed at a lower position of the maximum portion 16. Also, where the inner diameter (a) of the top end 4 of the inner periphery of the inner sack 1 is set to be 1, the width (e) in up and down directions of the temporarily fitting portion is required to be 0.10 to 0.19.

The inner sack 1 is to be mounted inside a container body 18 made of a metal material, and the flange 3 extending outward is formed at the top end of the outer periphery. A ring-shaped gasket 21 is disposed between the lower surface of the flange 3 and the upper surface of a ring-shaped projection 20 extending upward of the container body 18. This ring-shaped gasket seals and keeps the space between the lower surface of the flange 3 of the inner sack 1 and the inner surface of the ring-shaped projection 20 of the container body 18.

An upper gasket 22 is disposed between the top end of the inner sack 1 and the ring-shaped brim 13 arranged at the top end of the outer periphery of the housing 5. The upper gasket 22 prevents the propellant from leaking, which otherwise tends to leak outside between the outer periphery of the housing 5 and the inner surface of the inner sack 1. A ring-shaped rib 23 extends downward at the lower surface of the ring-shaped brim 13 for sealing well by pressing the top surface of the upper gasket 22.

A planer lid 24 having a cross section in a rectangular U-shaped is formed of a metal material on a top surface and is placed on an outer periphery of the ring-shaped brim 13, thereby covering the top surface of the housing 5. The lid 24 has an opening 25 for the stem 8 at a center of the lid to allow the top end of the stem 8 to project from the opening 25 outward.

A top edge 27 of the container body 18 is folded toward a top surface of the lid 24 and is secured, thereby surely securing the housing 5 to the container body 18. In accordance with the securing of the top edge 27 by folding the edge, a portion of the ring-shaped brim 13 is pressed toward the flange 3 of the inner sack 1, thereby pressing the upper gasket 22 and the ring-shaped gasket 21 to improve sealing property.

Since this invention is thus constituted, first, the inner sack 1 is mounted in the metal container body 18 to assemble the double chamber aerosol container. During this mounting, the flange 3 of the inner sack 1 is engaged with the top surface of the inner periphery of the ring-shaped projection 20 of the container body 18 through the ring-shaped gasket 21. The upper gasket 22 is subsequently disposed on the upper surface of the flange 3. To couple the housing 5 having the valve assembly 7 with the inner sack 1, the housing 5 is inserted in the opening 2 of the inner sack 1 from the temporarily fitting portion 15, and the insertion contact portion 14 formed at the outer periphery of the housing 5 is inserted and closely contacted with the top end of the inner periphery 4 of the opening 2 of the inner sack 1.

Because the outer diameter (b) of the insertion contact portion 14 is set to be 1.02 to 0.98 where the inner diameter (a) of the top end 4 of the inner periphery of the inner sack 1 is set to be 1, the insertion contact portion 14 is in close contact with the top end of the inner periphery of the opening 2 of the inner sack 1, and the inner sack 1 cannot be broken or positionally moved when the housing 5 is inserted. If the outer diameter (b) of the insertion contact portion 14 of the housing 5 is larger than 1.02, the insertion contact portion 14 of the housing 5 is inserted uneasily to the top end of the inner periphery of the inner sack 1, and the inner sack 1 may be moved upon being hit within the container body 18 or may be broken when the insertion contact portion 14 is inserted. On the other hand, if the outer diameter (b) of the insertion contact portion 14 of the housing 5 in contacting with the inner sack 1 is set smaller than 0.98, the insertion contact portion 14 of the housing 5 is inserted loosely to the top end 4 of the inner periphery of the inner sack 1. Therefore, the inner sack 1 is axially shifted from the insertion contact portion 14 of the housing 5, and the inner sack 1 is contracted unevenly by means of the insertion contact portion 14 when the housing 5 is mounted in the container body 18, thereby causing leakage. In addition, when the container body 18 is wrapped from its outer peripheral surface, intensity of such wrapping may become uneven, so that spraying gas may leak.

Where the inner diameter (a) of the top end 4 of the inner periphery of the inner sack 1 is set to be 1, the maximum outer diameter portion (c) of the temporarily fitting portion is set to be 0.97 to 0.95 so that the housing 5 can be inserted easily to the top end 4 of the inner periphery of the inner sack 1. If the maximum outer diameter portion (c) of the temporarily fitting portion 15 is set larger than 0.97 where the inner diameter (a) of the top end 4 of the inner periphery of the inner sack 1 is set to be 1, the temporarily fitting portion 15 cannot be inserted smoothly in the top end 4 of the inner periphery of the inner sack 1, and therefore, when the temporarily fitting portion 15 is inserted in the top end 4 in the inner sack 1, the maximum outer diameter portion (c) of the temporally fitting portion 15 may be caught to scratch the inner periphery of the top end of the inner sack 1, thereby creating causation for leakage.

If the maximum outer diameter portion (c) of the temporarily fitting portion 15 is set smaller than 0.95, a gap unnecessary for insertion work is created between the top end 4 of the inner periphery of the inner sack I and the portion, so that the temporarily fitting portion 15 is inserted too loosely to the top end 4 of the inner periphery of the inner sack 1, and so that the inner sack 1 is axially shifted from the insertion contact portion 14 of the housing 5. Consequently, wrinkles may be generated at the temporarily fitting portion 15 where the housing 5 is mounted on the container body 18, so that such wrinkles make uneven a contraction degree of the inner sack 1 by the insertion contact portion 14.

Because the minimum outer diameter portion (d) of the temporarily fitting portion is set to 0.94 to 0.88 where the inner diameter (a) of the top end 4 of the inner periphery of the inner sack is 1 and the minimum outer diameter portion is formed lower than a position of the maximum outer diameter portion, the temporarily fitting portion 15 has an introduction portion when the insertion contact portion 14 is inserted in the top end 4 of the inner periphery of the inner sack 1. This operation is, with respect to the above range, to prevent the inner sack 1 of the housing 5 from being caught or suffering from wrinkles.

If the minimum outer diameter portion (d) of the temporarily fitting portion 15 is set larger than 0.94 where the inner diameter (a) of the top end 4 of the inner periphery of the inner sack is 1, the lower end of the temporally fitting portion 15 may be caught when the temporarily fitting portion 15 is inserted in the top end 4 of the inner sack 1, thereby possibly scratching the top end 4 of the inner periphery of the inner sack 1, and creating causation for leakage.

If the minimum outer diameter portion (d) of the temporarily fitting portion 15 is set smaller than 0.87 where the inner diameter (a) of the top end of the inner periphery of the inner sack is 1, an unnecessary gap is created during insertion work between the top end 4 of the inner periphery of the inner sack 1 and the temporarily fitting portion 15 in the same manner as in the case that the maximum outer diameter (c) is made unnecessarily small. Therefore, the temporarily fitting portion 15 is inserted too loosely into the top end 4 of the inner periphery of the inner sack 1, so that the inner sack 1 is axially shifted from the insertion contact portion 14 of the housing 5, so that wrinkles may be generated at the temporarily fitting portion 15 where the housing 5 is mounted on the container body 18, and so that such wrinkles make uneven a contraction degree of the inner sack 1 by the insertion contact portion.

With this aerosol container, since the width (e) in the up and down directions of the temporarily fitting portion 15 is set to be 0.19 to 0.10 where the inner diameter (a) of the top end 4 of the inner periphery of the inner sack 1 is 1, adequate sealing is guaranteed between the insertion contact portion 14 and the top end 4 of the inner periphery of the inner sack 1, and the insertion contact portion 14 is surely guided to the top end 4 of the inner periphery of the inner sack 1 without any problem.

If the width in the up and down directions of the temporarily fitting portion 15 is made larger than 0.19, the length of the insertion contact portion 14 of the housing 5 is made shorter, so that adequate sealing may not be obtained between the insertion contact portion 14 and the top end 4 of the inner periphery of the inner sack 1. If the width in the up and down directions of the temporarily fitting portion 15 is made shorter than 0.10, the insertion contact portion 14 may not be guided smoothly to the top end of the inner periphery of the inner sack 1.

When the aerosol contents thus structured are to be sprayed, a proper button, not shown, is coupled to the stem 8 and pressed. Upon this pressing, the stem 8 slides toward the bottom of the mounting recess 6 in opposing the coil spring 10, thereby transforming the stem gasket 12 and opening the orifice 11.

The aerosol contents introduced in the spraying route from the orifice 11 are sprayed outside the nozzle or the like of the bottom. When the stem 8 is released from pressing, the stem 8 returns upward by a return force of the coil spring 10, and spraying of the aerosol contents is stopped because the orifice 11 is sealed by the stem gasket 12.

In a case where the aerosol container is unused for a long time or displayed for sales for a long time, the above material forming the inner sack 1 allows the propellant to premeate little by little. The propellant thus permeated, tries to leak out via a space between the container body 18 and the inner sack 1, but it is prevented from leaking outside because the ring-shaped gasket 21 is placed between the lower surface of the flange 3 of the inner sack 1 and the upper surface of the ring-shaped projection 20 of the container body 18, thereby never releasing outside the gas permeated through the inner sack 1.

The upper gasket 22 also prevents the propellant from leaking out which otherwise leaks through a space between the outer periphery of the housing 5 and the inner periphery 1 of the inner sack 1. Therefore, even where the aerosol container is preserved for a long time, the propellant would not be dissipated through permeation, so that the aerosol container can do always good spraying of the aerosol contents.

The lid 24 in which the metal plate is folded into a shape having the rectangular U-shaped cross section is placed on a top end of the housing 5, and the top edge 27 of the container body 18 is folded and secured to the top surface of the lid 24. Therefore, the aerosol container can be assembled readily. Since the container body 18 of the housing 5 is pressed inward in association with folding of the top edge 27, the top end of the flange 3 is surely in contact with the lower surface of the ring-shaped brim 13 via the upper gasket 22, and the lower surface of the flange 3 is surely in contact with the upper surface of the ring-shaped projection 20 via the ring-shaped gasket 21, so that the aerosol container can improve the sealing property further.

The followings are prescriptions of respective contents where, in the inner sack 1 of the container body 18 thus formed, a soft type hair spray, hair foam, kerosene basis insecticide for air spraying, water basis insecticide for gardening, agent for permanently waving treatment, acidic hair dye, oxidizing two-agent type permanent hair dye, depilatory, or waterproofing agents, is filled.

| Soft Type Hair Spray | |
|---|---|
| Acrylic resin alkanol amine liquid (30%) | 2.00 weight % |
| Polyoxyethylene oleyl ether | 0.01 weight % |
| Perfume | 0.17 weight % |
| Denatured ethylalcohol | 52.82 weight % |
| Propellant LPG | 45.00 weight % |
| Total | 100.00 weight % |

| Hair Foam | |
|---|---|
| Denatured ethyl alcohol | 9.00 weight % |
| Cetyl alcohol | 0.20 weight % |
| Stearyl alcohol | 0.20 weight % |
| Methylpolysiloxyane-polyoxyalkylene copolymer | 0.10 weight % |
| Polyoxyethylenealkylether (E.O.13) | 0.60 weight % |
| Cationic cellulose | 3.00 weight % |
| Polyoxyethylenesorbitan monolauric acid (E.O.6) | 0.40 weight % |
| Hydrolysis collagen | 0.40 weight % |
| Glycerin | 0.10 weight % |
| Stearyltrimethylammoniumchloride | 0.05 weight % |
| Perfume | 0.10 weight % |
| Refined water | 78.85 weight % |
| Propellant LPG | 7.00 weight % |
| Total | 100.00 weight % |

| Kerosine Basis Insecticide for air spraying | |
|---|---|
| Insecticide source | 0.35 weight % |
| Effect intensifier | 1.95 weight % |
| Perfume | 0.01 weight % |
| Kerosine | 47.69 weight % |
| Propellant LPG | 50.00 weight % |
| Total | 100.00 weight % |

| Water Basis Insecticide for gardening | |
|---|---|
| Insecticide source | 0.20 weight % |
| Activation agent | 0.07 weight % |
| Anticorrosion agent | 0.30 weight % |
| Silicon | 0.07 weight % |
| Ion Exchanged water | 72.32 weight % |
| Propellant DME/LPG = 70/30 | 26.50 weight % |
| Total | 100.00 weight % |

| Agent for permanent waving treatment | |
|---|---|
| Thioglycoilc acid ammonium (50% solution) | 9.50 weight % |
| Ammonium solution (28%) | 1.40 weight % |
| Liquid paraffin | 0.95 weight % |
| Surfactant | 1.90 weight % |
| Propylene glycol | 4.75 weight % |
| Chelating agent | 0.10 weight % |
| Refined water | 76.40 weight % |
| Propellant LPG | 5.00 weight % |
| Total | 100.00 weight % |

| Acidic hair dye | |
|---|---|
| Dye | 0.95 weight % |
| Benzylslcohol | 9.50 weight % |
| N-methylpyrrolidone | 9.50 weight % |
| Hydroxyethylcellulose | 0.95 weight % |
| Surfactant | 4.75 weight % |
| Citric acid (pH adjustment) | 2.90 weight % |
| Refined water | 66.45 weight % |
| Propellant LPG | 5.00 weight % |
| Total | 100.00 weight % |

| Depilatory | |
|---|---|
| Thioglycolic acid calcium | 4.75 weight % |
| Thioglycolic acid | 4.75 weight % |
| Sodium hydroxide | 2.09 weight % |
| Calcium hydroxide | 0.95 weight % |
| Surfactant | 4.74 weight % |

-continued

| | |
|---|---|
| Cetyl alcohol | 0.95 weight % |
| Refined water | 76.77 weight % |
| Propellant LPG | 5.00 weight % |
| Total | 100.00 weight % |
| Oxidizing two-agent type permanent hair dye | |
| First agent | |
| Oxidizing dye | 5.00 weight % |
| Resorcin | 5.00 weight % |
| Oleic acid | 2.00 weight % |
| Polyethylene glycol | 7.00 weight % |
| Aqueous ammonia (28%) | 0.20 weight % |
| Antioxidant | 0.05 weight % |
| Chelating agent | 0.50 weight % |
| Surfactant | 0.10 weight % |
| Refined water | 10.00 weight % |
| Propellant LPG | 60.15 weight % |
| Total | 100.00 weight % |
| Second agent | |
| Hydrogen peroxide (35%) | 14.250 weight % |
| Cetyl alcohol | 1.900 weight % |
| Surfactant | 0.950 weight % |
| Edetic acid | 0.475 weight % |
| Phenacetin | 0.095 weight % |
| Refined water | 77.330 weight % |
| Propellant LPG | 5.000 weight % |
| Total | 100.00 weight % |
| Waterproofing spray | |
| Waterproofing source | 1.36 weight % |
| Silicon | 2.04 weight % |
| IPA | 64.60 weight % |
| Propellant LPG | 32.00 weight % |
| Total | 100.00 weight % |

This invention is thus constituted, so that in the double chamber aerosol container in which the inner sack is mounted in the metal container body, the propellant is prevented from permeating outside and pressure of the aerosol container is prevented from lowering, and so that the aerosol container can spray the aerosol contents always in a good way even where it is subjected to a long term preservation or exhibition.

With this invention, the insertion contact portion of the housing is made larger than the diameter of the top the inner periphery of the inner sack to improve contact between the insertion contact portion and the top end of the inner periphery, thereby preventing the inner sack from being broken, allowing the housing and the inner sack to be fitted precisely without inclining or moving the inner sack when the housing is mounted on the inner sack, and preventing leakage of air from occurring from a viewpoint of assembling.

The foregoing description of the preferred embodiments of the invention has been presented for the purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention should not be limited by the specification, but be defined by the claims set forth below.

What is claimed is:

1. A double chamber aerosol container comprising:

a housing having a valve assembly, a ring-shaped brim extended from a top end of an outer periphery of the housing, an insertion contact portion, and a temporarily fitting portion formed at a lower end of the insertion contact portion;

an inner sack made of a soft, elastic material, closely contacting with the insertion contact portion of the housing at a top end of an inner periphery of the inner sack and having a flange projecting from an top end of an outer periphery of the inner sack;

a container body made of a metal, placed inside the inner sack and having a ring-shaped projection extending inward;

a ring-shaped gasket placed between an upper surface of the ring-shaped projection extending inward in the container body and a lower surface of the flange of the inner sack; and a ring-shaped top gasket disposed between a top end surface of the inner sack and the ring-shaped brim extended from the top end of the outer periphery of the housing, wherein, where an inner diameter of the top end of the inner periphery of the inner sack is 1, an outer diameter of the insertion contact portion of the housing in contacting with the inner sack is set to 1.02 to 0.98; a maximum outer diameter portion of the temporarily fitting portion is set to 0.97 to 0.95; a minimum outer diameter portion of the temporarily fitting portion is set to 0.94 to 0.88; a width in up and down directions of the temporarily fitting portion is 0.10 to 0.19; and the minimum outer diameter portion is formed lower than a position of the maximum outer diameter portion.

2. The double chamber aerosol container according to claim 1, wherein a lid having an orifice for a stem formed at a center of the lid is disposed on a top end surface of the housing, and wherein the container body is secured to the housing upon folding a top edge of the container body toward a top surface of the lid.

3. The double chamber aerosol container according to claim 1, wherein the inner sack is formed of a sheet or film of a single layer using a material which is selected from ethylenevinylalcohol, polypropylene, polyacrylonitrile, polyethyleneterephthalate, high density polyethylene, low density polyethylene, straight-chain type low density polyethylene, and polyamide.

4. The double chamber aerosol container according to claim 1, wherein the inner sack is formed of a sheet or film of multiple layers stacked of multiple materials selected from ethylenevinylalcohol, polypropylene, polyacrylonitrile, polyethyleneterephthalate, high density polyethylene, low density polyethylene, straight-chain type low density polyethylene, and polyamide.

5. The double chamber aerosol container according to claim 1, wherein the inner sack is formed of a multilayer sheet or film in which a polyethylene or polypropylene is disposed on opposite surfaces of an ethylenevinylalcohol film.

* * * * *